US005456758A

United States Patent [19]

Menon

[11] Patent Number: 5,456,758

[45] Date of Patent: Oct. 10, 1995

[54] SUBMICRON PARTICLE REMOVAL USING LIQUID NITROGEN

[75] Inventor: Venugopal B. Menon, Austin, Tex.

[73] Assignee: Sematech, Inc., Austin, Tex.

[21] Appl. No.: 53,921

[22] Filed: Apr. 26, 1993

[51] Int. Cl.[6] ..... B08B 7/04

[52] U.S. Cl. ..... 134/33; 134/31; 134/34; 134/902

[58] Field of Search ..... 134/21, 33, 34, 134/31, 902

[56] References Cited

U.S. PATENT DOCUMENTS

| | | | |
|---|---|---|---|
| 4,409,034 | 10/1983 | Williams | 134/4 |
| 4,491,484 | 1/1985 | Williams | 134/4 |
| 4,554,025 | 11/1985 | Burke et al. | 134/17 |
| 4,817,652 | 4/1989 | Liu et al. | 134/102 |
| 4,962,776 | 10/1990 | Liu et al. | 134/11 |
| 5,062,898 | 11/1991 | McDermott et al. | 134/7 |
| 5,213,619 | 5/1993 | Jackson et al. | 134/1 |
| 5,316,591 | 5/1994 | Chao et al. | 134/34 |

FOREIGN PATENT DOCUMENTS

| | | |
|---|---|---|
| 3-190131 | 8/1991 | Japan . |
| 4-116928 | 4/1992 | Japan . |

OTHER PUBLICATIONS

"Surface Cleaning by a Cryogenic Argon Aerosol", McDermott et al., 1991 Proceedings–Institute of Environmental Sciences, pp. 882–885.

"Temperature–Dependent Van Der Waals Forces", V. A. Parsegian et al., Biophysical Journal 10, pp. 664–674 (1970).

"Ice Scrubber Cleaning", Toshiaka Ohmori et al., Technical Proceedings Semicon/Kansai–Kyoto, Jun. 21–23, 1990, pp. 142–149.

*Primary Examiner*—David A. Simmons
*Assistant Examiner*—Sean Vincent
*Attorney, Agent, or Firm*—William W. Kidd

[57] ABSTRACT

Liquid nitrogen is introduced onto a surface of a semiconductor wafer to remove submicron particles from its surface. $LN_2$ flows across the wafer surface wherein the surface tension of the liquid collects contaminant particles and removes them off the edge of the wafer.

11 Claims, 2 Drawing Sheets

Fig. 1
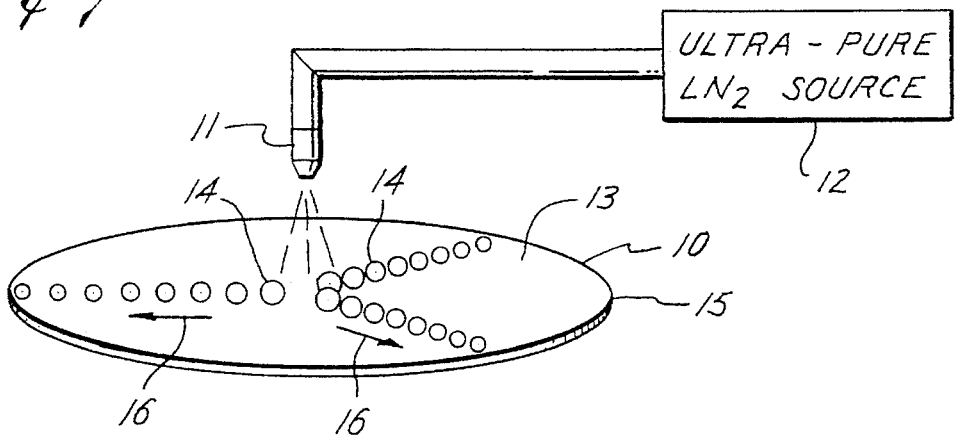
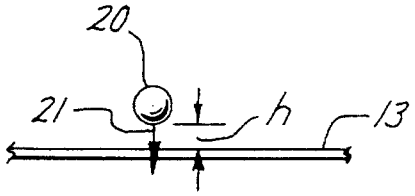
Fig. 2
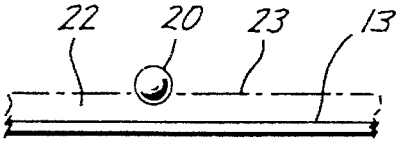
Fig. 3
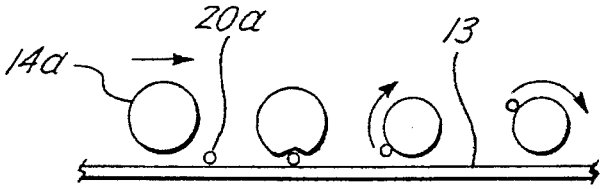
Fig. 4
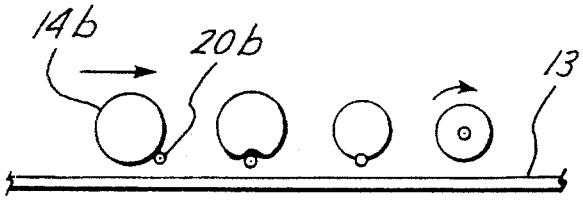
Fig. 5

SUBMICRON PARTICLE REMOVAL USING LIQUID NITROGEN

BACKGROUND OF THE INVENTION

1. Field of the Invention

The present invention relates to the field of removing particles from a surface and, more particularly, to the cleaning of semiconductor wafers by the removal of particulate contaminants from a wafer surface.

2. Prior Art

In the process of manufacturing devices on a semiconductor wafer, a number of steps require the cleaning of the surface of the wafer to remove unwanted particles. Such particles will generally contaminate subsequent processing steps and/or introduce defects which can result in the failure of the integrated circuit device being manufactured. Furthermore, such defects can result in lower yields, which ultimately impact the economic cost associated with the manufacturing of integrated circuit devices. Additionally, as the various circuit dimensions shrink to a submicron level, contamination constraints are made ever more stringent. For example, smaller size particles which may not have caused a defect on a 1.0 micron electrical line of a wafer will have a likelier chance of causing a defect on a 0.35 micron, 0.25 micron or 0.15 micron electrical line.

A variety of techniques have been proposed and implemented in the prior art in order to clean semiconductor wafers. Two of the more popular techniques are the use of ultrasonic and megasonic cleaning systems. Typically, 25 to 50 wafers are immersed in an alkaline solution of ammonium hydroxide, water and hydrogen peroxide for approximately 10 minutes. In the bath, the wafers are subjected to high frequency sound waves in the range of 25–1000 KHz. Subsequently, the wafers are rinsed and dried, requiring additional time of 5–15 minutes. Ultrasonic systems use the lower frequency range while megasonic systems use the higher frequency range. A listing of various known techniques is well described in U.S. Pat. No. 4,817,652 (Liu et al.).

It should be emphasized that many of the prior art techniques, which may be effective in removing contaminating particles, require the use of chemicals which are harmful to the environment or to humans who must work with the chemicals. Waste disposal of such harmful chemicals adds another significant concern in protecting the environment. In order to be more sensitive to environmental issues, the semiconductor industry is concerned with developing new wafer cleaning techniques which are more "environment friendly."

For example, two recent techniques for cleaning wafers can be found in U.S. Pat. No. 5,062,898 (McDermott et al.) and in an article entitled "Ice Scrubber Cleaning", Ohmori et al., Technical Proceedings Semicon/Kansai-Kyoto, pp. 142–149 (Jun. 21–23, 1990). Both of these techniques provide for a more "environment friendly" approach to wafer cleaning. McDermott et al. discloses a surface cleaning method using an argon cryogenic aerosol. Cleaning of contaminated surfaces is accomplished through a process of colliding solid (frozen) argon particles at high velocity against the surface to be cleaned. The Ohmori et al. article discloses the use of impacting solid ice particles to scrub the wafer surface.

However, both techniques (McDermott et al. and Ohmori et al.) still require the cooling of a gas or a liquid by the use of a cryogenic element. In McDermott et al., argon gas is cooled and solidified in an heat exchanger, which is cooled by liquid nitrogen. In Ohmori et al., nitrogen is used as a coolant to form ice particles from ultra pure de-ionized (DI) water and a carrier gas (nitrogen) is utilized to jet the ice particles.

The present invention provides for an "environment friendly" technique of cleaning a wafer, but without the necessary requirement of forming solid particles to blast or scrub the surface of the wafer.

SUMMARY OF THE INVENTION

The present invention pertains to a technique of utilizing liquid nitrogen ($LN_2$) to remove particles from a semiconductor wafer surface, as well as other surfaces that need to be cleaned. $LN_2$ is introduced onto the wafer in liquid form and is made to roll or sheet across the wafer surface. Surface tension exerted by the $LN_2$ droplets collect the particles as the droplets come in contact with the particles. The droplets then carry the particles off of the edge of the wafer.

The evaporation of $LN_2$ on the wafer surface forms a gaseous nitrogen layer above the wafer surface, which contributes to the movement of $LN_2$ to readily skim over the gaseous layer. Additionally, the cryogenic temperatures aid in reducing the adhesive force adhering the particles to the wafer surface, thereby aiding in dislodging the particles from their static position.

In one embodiment, a nozzle is disposed above the center of the wafer to introduce $LN_2$. In another embodiment, an elongated bar with a slit is made to transition across the wafer surface, introducing $LN_2$ as it moves across the wafer. Furthermore, placing the wafer on a rotating chuck permits centrifugal force to facilitate the flow of $LN_2$ and the removal of particles from the wafer surface.

BRIEF DESCRIPTION OF THE DRAWINGS

FIG. 1 is a pictorial diagram showing an introduction of $LN_2$ onto a semiconductor wafer in the practice of the present invention.

FIG. 2 is a cross-sectional diagram showing a disposition of a contaminant particle on a surface of a wafer and an adhesive force adhering the particle to the wafer.

FIG. 3 is a cross-sectional diagram showing a formation of a nitrogen gas layer above the wafer surface as a result of the evaporation of $LN_2$.

FIG. 4 is a cross-sectional diagram showing a transition of a $LN_2$ droplet collecting a particle as it transitions across the wafer surface.

FIG. 5 is a cross-sectional diagram showing a transition of a $LN_2$ droplet engulfing a particle as it transitions across the wafer surface.

DETAILED DESCRIPTION OF THE PREFERRED EMBODIMENTS

Figure 6:
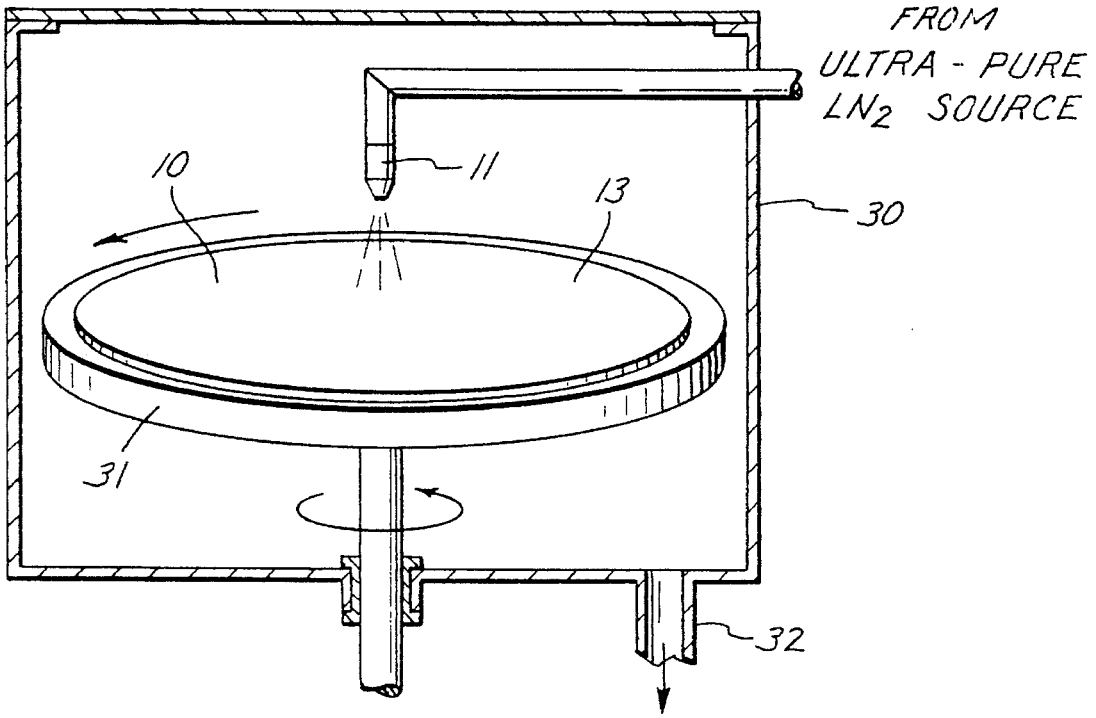
FIG. 6 is an illustration of an apparatus of the present invention in which the wafer of FIG. 1 is disposed on a rotating chuck and enclosed in a housing.

A technique for removing contaminant particles from a surface of a semiconductor wafer without the use of environmentally harmful chemicals is described. In the following description, numerous specific details are set forth, such as specific devices, dimensions, chemical compositions, etc., in order to provide a thorough understanding of the present invention. However, it will be obvious to one skilled in the art that the present invention may be practiced without these specific details. In other instances, well known processes and structures have not been described in detail in order not to unnecessarily obscure the present invention.

The present invention describes a technique of using liquid nitrogen to remove contaminant particles from a surface, such as a silicon wafer. Wafers are exposed to liquid nitrogen ($LN_2$) either in the form of a liquid jet or as droplets. The subsequent rapid evaporation of the droplets and their tendency to shear (roll) away from the wafer results in the removal of loosely bound particles.

Referring to FIG. 1, a wafer 10, which is to be cleaned, is disposed under a nozzle 11. Nozzle 11 is coupled to an ultra-pure $LN_2$ source 12 in order to introduce $LN_2$ onto a surface 13 of wafer 10. Wafer 10 can be a blank wafer or it may contain completed or partially-completed integrated circuit devices thereon. The purity of $LN_2$ will depend on the size of particles which are to be removed from the surface 13, but for sub-micron wafer processing applications, ultra-pure $LN_2$ will be needed in order not to introduce any further contaminants in the sub-micron range.

The nozzle 11 can be a spout, sprayer or a jet, depending on the choice in the manner in which $LN_2$ is to be introduced. The $LN_2$ can be poured onto the wafer, introduced as a stream by use of a jet or introduced in the form of a spray of droplets. The manner in which $LN_2$ is introduced onto the wafer 10 is a design choice and will depend on the particular process application. It is preferred that the nozzle 11 be disposed above the center of the wafer 10. The height of the nozzle 11 above surface 13 will depend on the particular application and the nozzle chosen, but generally will be in the range of 5 millimeters to 10 centimeters.

As the $LN_2$ contacts the wafer surface 13, it starts evaporating rapidly, either sheeting from the surface 13 or forming large droplets 14, which roll from the center of the wafer 10 toward its periphery. Due to the force of the $LN_2$ being introduced onto the wafer 10, $LN_2$ sheets and/or droplets 14 will flow across the surface 13 and exit off the edge 15 of the wafer 10 at its periphery. Either by the sheeting or rolling action of $LN_2$ across the wafer 10, $LN_2$ collects particles from the surface 13 and carries such particles off of edge 15. The flow of $LN_2$ is denoted by arrows 16 in FIG. 1. Generally, the droplets 14 become smaller due to the evaporation as they transit across the wafer 10.

How the particles are captured by the flow of $LN_2$ is described in reference to FIGS. 2–5. Referring to FIG. 2, a submicron particle 20, which is a contaminant, is shown disposed on surface 13. In actuality particle 20 is suspended above surface 13 by a distance h due to atomic forces. Distance h is dependent on the size of the particle and generally will vary from approximately 2 to 50 Angstroms. As noted by arrow 21, an adhesion force directed towards surface 13 is present to adhere particle 20 to surface 13.

When $LN_2$ is poured onto the surface 13, the exposure of $LN_2$ to a warmer surrounding causes the rapid evaporation of $LN_2$. This rapid evaporation of $LN_2$ forms a nitrogen ($N_2$) vapor layer 22 above the wafer surface 13, as shown in FIG. 3. This $N_2$ vapor layer 22 is present about and under particle 20. As the droplets 14 roll across surface 13, the droplets 14 tend to skim across the surface 23 of the vapor layer 22. The actual thickness of the vapor layer 22 between the wafer surface 13 and droplet 14 will depend on the size of the droplets 14, but generally will be in the range of 5 Angstroms to approximately $10^7$ Angstroms depending on the weight (size) of the droplets.

As shown in FIG. 4, a droplet **14*a* starts its course near the center of the wafer 10 and travels across towards the wafer edge 15 by skimming across the surface 23 of $N_2$ vapor layer 22. When a particle 20*a*, which is of sufficient size to be exposed above the $N_2$ surface 23, is encountered, the momentum of the rolling force carries the droplet 14*a* over the particle 20*a*. Upon crossing the particle 20*a*, a surface tension between the droplet 14*a* and particle 20*a* results in the particle 14*a* being attached to droplet 14*a*. The droplet 14*a* then continues to roll, carrying the particle 20*a*, and eventually both roll off of edge 15. It is imperative that not all of the droplets evaporate before reaching the edge 15, so that particles are carried completely off of the wafer and not merely transported and deposited at another location on the wafer 10**.

Referring to FIG. 5, it illustrates a similar sequence of events as droplet **14*b* rolls across surface 13. However, in this instance, particle 20*b* is enveloped within the droplet 14*b* and engulfed therein, instead of being transported on the surface of the droplet 14*b*. By either method, or the combination of both methods, the particle 14*b* is removed from the surface of the wafer 10**.

Furthermore, the use of cryogenic temperatures has an added property in removing particles 14 from the wafer surface 13. The force of adhesion of a spherical particle on a planar surface is given by:

$$F_{ad}=A*d/12h^2 \qquad \text{(Equation 1)}$$

where A is the Hamaker constant for the particle-surface system, d is the diameter of the particle and h is the separation distance between the particle and the wafer surface.

The Hamaker constant is a unique property of the materials in contact and the fluid medium between them. The Hamaker constant is also known to decrease noticeably with a decrease in the temperature (see, "Temperature-Dependent Van Der Waals Forces", Parsegian et al., BioPhysical Journal Volume 10, pp 664–674, 1970.). The adhesion force in the presence of a cryogenic medium, such as $LN_2$, is expected to be lower than at room or elevated temperatures. Accordingly, the adhesion force 21 shown in FIG. 1 is lowered when cryogenic nitrogen gas forms layer 22 above the wafer 10, thereby increasing the probability of capture by droplet 14 when droplet 14 encounters particle 20.

Referring to FIG. 6, an apparatus of the present invention is shown. The wafer 10 and the $LN_2$ nozzle 11 of FIG. 1 are enclosed within a housing 30 for performing the cleaning operation. The wafer 10 rests atop a platen, such as a wafer chuck 31, and the nozzle 11 is coupled to an ultra-pure $LN_2$ source, typically located away from the housing. It should be appreciated that the housing itself is located in a clean environment, such as a clean room.

Housing 30 is also coupled to an exhaust system through exhaust opening 32. The interior of the housing 30 is typically at ambient, but can be at other temperatures as well. The exhaust system coupled to the housing 30 is for exhausting particles and nitrogen vapors removed from the wafer 10.

The chuck 31 is rotated to obtain centrifugal action. The speed of rotation is a design choice, but generally can be in the range of 50–2000 rpm. The centrifugal force provides an added impetus to carry the droplets 14 across the surface of the wafer 10, as well as exerting a force on the particle 14 themselves. Furthermore, because nitrogen is "environment friendly", the $N_2$ gas exhaust from the housing 30 can be readily vented out to the environment. The $LN_2$ will be in a gaseous $N_2$ form for exhaust. It should also be stressed that the wafer is self drying. Since $LN_2$ evaporates rapidly, no time consuming drying cycles are required.

Figure 7:
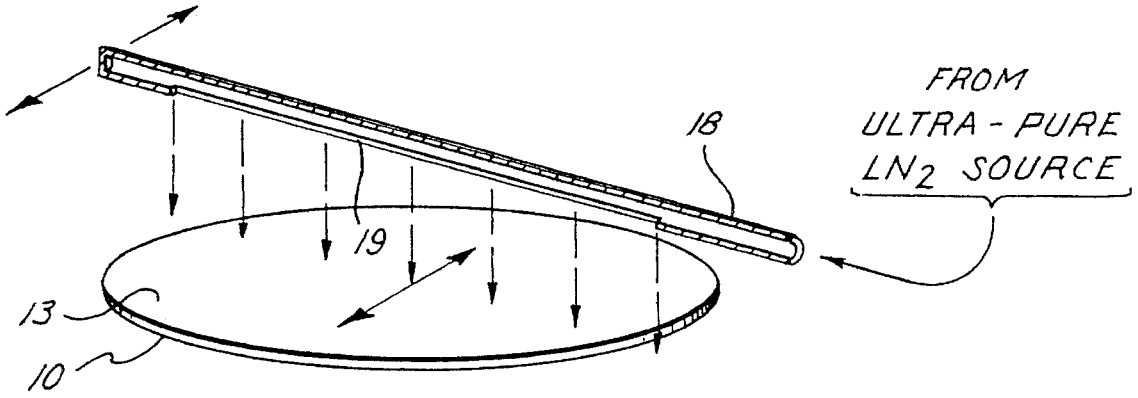
FIG. 7 is a pictorial drawing showing a bar transitioning across the wafer surface in order to introduce a sheet of $LN_2$ onto the wafer as an alternative technique of practicing the present invention.

Referring to FIG. 7, an alternative embodiment of the present invention is shown. Instead of the earlier described nozzle 11, a bar 18 extends across the diameter of the wafer 10. The bar 18 shown is a capillary tube having a slit opening 19 which extends at least the diameter of the wafer 10. One end of the bar is coupled to the ultra-pure $LN_2$ source while the other end is capped. As $LN_2$ flows into bar 18, $LN_2$ exits through slit 19 to pour onto wafer 10. Simultaneously to the introduction of $LN_2$ or thereabouts, bar 18 is made to move in a planar motion across the wafer surface 13. Thus, the bar transitions across the complete surface of the wafer pouring $LN_2$ onto the wafer. Alternatively, the bar 18 can be stationary while the wafer 10 is moved in a planar motion below the bar 18.

Now, if the wafer 10 is angled from the horizontal, or even placed perpendicular to the horizontal (vertical), and if the bar commences its transition from the higher angled position, $LN_2$ can be made to flow downward in one direction by the force of gravity. As the bar 18 sweeps across surface 13 of the wafer 10, $LN_2$ droplets 14 will roll downward removing particles 20 from the wafer surface 13.

It is to be appreciated that the relative motion between the bar 18 and wafer 10 can be achieved by the movement of the bar 18, movement of the wafer 10 or movement of both parts 10 and 18. It is to be further appreciated that the technique shown in FIG. 7 can be readily adapted into a housing, similar to the housing 30 of FIG. 6, in order to provide an alternative cleaning apparatus of the present invention. Furthermore, if desired, wafer 10 can also be made to spin when using the technique described in reference to FIG. 7.

The description above and the accompanying drawings reference $LN_2$ droplets. It should be noted that the flow of sheets of $LN_2$ across the wafer functions equivalently to the droplets in capturing and/or engulfing the particles as the $LN_2$ sheets move across the wafer surface. The alternative embodiment relies more on the sheeting action of $LN_2$ rather than the droplet action, since the bar pours $LN_2$ across the face of the wafer 10 as it is relatively transitioned across the wafer surface 13.

Furthermore, the practice of the present invention can be readily extended to multiple wafer (batch) systems, as well as to other applications, including the cleaning of disk drives, precision metallic and plastic parts, electropolished surfaces, optics, photomasks and medical components, to name a few, especially where often Freon® compounds are utilized (Freon® is a trademark of E. I. DuPont de Nemours and Company). The present invention is quite attractive as a replacement for chloro-fluoro carbon (CFC) when used as a cleaner. However, when using $LN_2$, component response to the thermal stress due to $LN_2$ must be considered in practicing the technique of the present invention. Also, the wafer is typically a silicon wafer, but it need not be limited to silicon.

Additionally, the practice of the present invention does not require the use of acids or alkalis, ultrasonic or megasonic energy generation, and time consuming wafer drying steps, as well. It is also appreciated that other "environment friendly" cryogenic liquids can be readily substituted for the $LN_2$ to practice the present invention without departing from the spirit and scope of the present invention.

Thus, a scheme for removing contaminant particles from a surface of a semiconductor wafer utilizing liquid nitrogen is described.

I claim:

1. A method of removing particles from a surface of a semiconductor wafer which is to be cleaned, comprising the steps of:

introducing a cryogenic liquid which is nontoxic to the environment onto said surface such that said cryogenic liquid begins to evaporate to form a vapor layer above said surface;

sheeting or rolling said cryogenic liquid across said surface and ensuring that not all of said cryogenic liquid evaporates prior to reaching a boundary of said surface;

removing said particles, such that said sheeting or rolling of said cryogenic liquid occurs above said vapor layer wherein momentum from motion of said cryogenic liquid and surface tension between said cryogenic liquid and said particles dislodge particles that are exposed above said vapor layer by having said particles adhere to or engulfed by said cryogenic liquid as said cryogenic liquid transitions across said surface to remove said particles from said surface.

2. The method of claim 1 wherein said cryogenic liquid is liquid nitrogen ($LN_2$).

3. The method of claim 1 wherein said cryogenic liquid is introduced onto said surface through a nozzle disposed proximal to said surface.

4. The method of claim 1 wherein said cryogenic liquid is introduced onto said surface through an elongated bar having a slit extending across a width of said surface and disposed proximal to said surface.

5. The method of claim 4 wherein said slit is moved across said surface in order to pour said cryogenic liquid across all of said surface.

6. A method of removing submicron particles from a surface of a semiconductor wafer which is to be cleaned by utilizing a nontoxic cryogenic liquid which can be vented to the atmosphere, comprising the steps of:

introducing a continuous stream of ultra-pure liquid nitrogen ($LN_2$) onto said wafer surface such that said $LN_2$ begins to evaporate to form a vapor layer above said wafer surface;

sheeting or rolling said $LN_2$ across said wafer surface and ensuring that not all of said $LN_2$ evaporates prior to reaching an edge of said wafer; removing said particles, such that said sheeting or rolling of said $LN_2$ occurs above said vapor layer wherein momentum from motion of said $LN_2$ and surface tension between said $LN_2$ and said particles dislodge particles that are exposed above said vapor layer by having said particles adhere to or engulfed by said $LN_2$ as said $LN_2$ transitions across said wafer surface and off of said edge to remove said particles from said wafer surface.

7. The method of claim 6 wherein said wafer is spun such that centrifugal force exerted by said spinning enhances transition of said $LN_2$ across said wafer surface and enhances removal of said particles.

8. The method of claim 7 wherein said $LN_2$ is introduced onto said surface through a nozzle disposed centrally above said wafer surface.

9. The method of claim 6 wherein said $LN_2$ is introduced onto said wafer surface through an elongated bar disposed proximal to said wafer surface and having a slit extending across the diameter of said wafer.

10. The method of claim 9 wherein said bar is moved across said wafer in order to pour $LN_2$ across all of said wafer surface.

11. The method of claim 10 wherein said wafer is tilted from a horizontal position in order to have gravity aid in flow of said $LN_2$ across said wafer surface.

* * * * *

UNITED STATES PATENT AND TRADEMARK OFFICE

CERTIFICATE OF CORRECTION

PATENT NO. : 5,456,758

DATED : October 10, 1995

INVENTOR(S) : Venugopal B. Menon

It is certified that error appears in the above-indentified patent and that said Letters Patent is hereby corrected as shown below:

Column 2, line 2, "an" should be --a--.

Column 4, line 67, "particle 14" should be --particles 20--.

Column 6, line 54, "removing" should begin a new paragraph..

Signed and Sealed this

Nineteenth Day of August, 1997

*Attest:*

Bruce Lehman

BRUCE LEHMAN

*Attesting Officer*

*Commissioner of Patents and Trademarks*